US008967835B2

(12) United States Patent
Tseng

(10) Patent No.: US 8,967,835 B2
(45) Date of Patent: Mar. 3, 2015

(54) LENS HAVING POSITIONING STRUCTURE FOR ACCURATELY MOUNTING THE LENS OVER A LIGHT SOURCE MODULE

(71) Applicant: Hon Hai Precision Industry Co., Ltd., New Taipei (TW)

(72) Inventor: Yung-Chang Tseng, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/896,341

(22) Filed: May 17, 2013

(65) Prior Publication Data

US 2014/0177233 A1 Jun. 26, 2014

(30) Foreign Application Priority Data

Dec. 24, 2012 (TW) ..... 101149426 A

(51) Int. Cl.
*F21V 17/18* (2006.01)

(52) U.S. Cl.
CPC ..... *F21V 17/18* (2013.01)
USPC ..... 362/311.02; 362/335

(58) Field of Classification Search
USPC ..... 362/311.02, 311.06, 249.02, 335, 362/296.05
See application file for complete search history.

(56) References Cited

U.S. PATENT DOCUMENTS 8,052,307 B2 * 11/2011 Bak et al. ..... 362/257
8,573,815 B2 * 11/2013 Mallory et al. ..... 362/311.02
2014/0160768 A1 * 6/2014 Tang et al. ..... 362/335

* cited by examiner

*Primary Examiner* — Tracie Y Green
(74) *Attorney, Agent, or Firm* — Novak Druce Connolly Bove + Quigg LLP

(57) ABSTRACT

An exemplary lens for regulating light of an LED includes a light guiding portion and a latching portion extending downwardly from the light guiding portion. The light guiding portion includes a top surface and a bottom surface opposite to the top surface. A center of the bottom surface is depressed toward the top surface to form an optical concave. The latching portion is formed at the bottom surface and located around the optical concave surface. The latching portion defines an engaging hole to fittingly receive the LED therein. A light source module having the lens is also provided.

2 Claims, 3 Drawing Sheets

LENS HAVING POSITIONING STRUCTURE FOR ACCURATELY MOUNTING THE LENS OVER A LIGHT SOURCE MODULE

BACKGROUND

1. Technical Field

The present disclosure generally relates to optical elements, and particularly to a lens which has a positioning structure capable of accurately mounting the lens over a light source module, for example, an LED package.

2. Description of the Related Art

LEDs (light emitting diodes) are solid state light emitting source, which are more stable and reliable than other conventional light sources such as incandescent bulbs. Thus, LEDs are being widely used in various fields such as numeral/character displaying elements, signal lights, light sources for lighting and display devices.

A conventional light source module includes a printed circuit board, an LED mounted on the printed circuit board by SMT (surface mounted technology), and a lens covering the LED and mounted on the circuit board. Positioning pins of the lens are adhered on patterned zones of the printed circuit board via glue. Since there are position errors when the LED and the lens are mounted on the circuited board, the lens cannot precisely cover the LED at the required position, whereby the lens cannot precisely refract the light from the LED in a manner as required. Accordingly, the light distribution obtained by the conventional LED and lens assembly sometimes cannot satisfy the predetermined requirement.

Therefore, it is desirable to provide a light source module having a lens which can overcome the above-described problems.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the present light source module. Moreover, in the drawings, all the views are schematic, and like reference numerals designate corresponding parts throughout the views.

DETAILED DESCRIPTION

Figure 1:
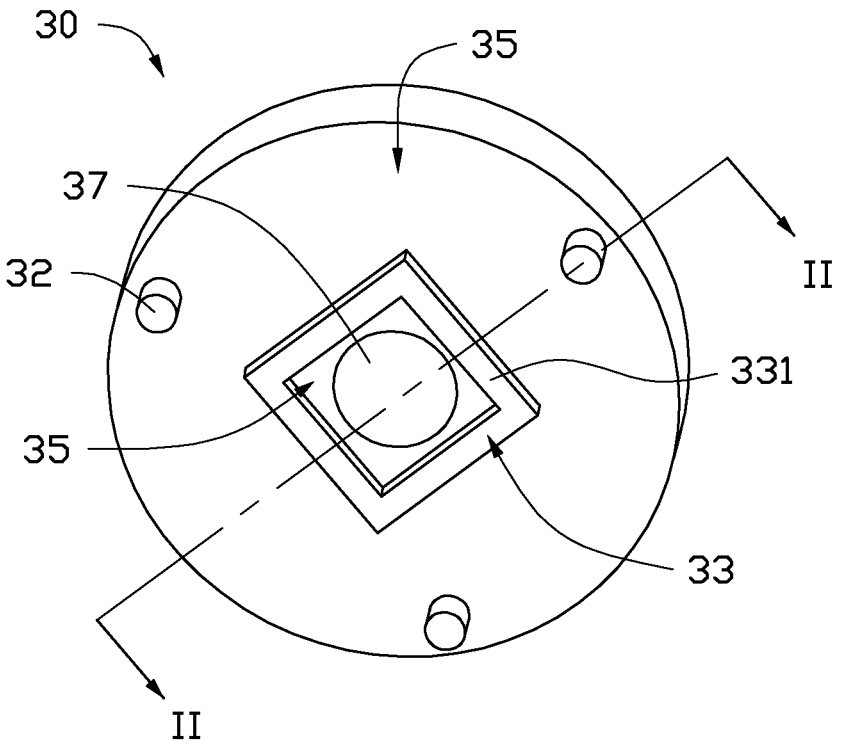
FIG. 1 is an isometric view of a lens of a light source module in accordance with one embodiment of the present disclosure.
Figure 2:
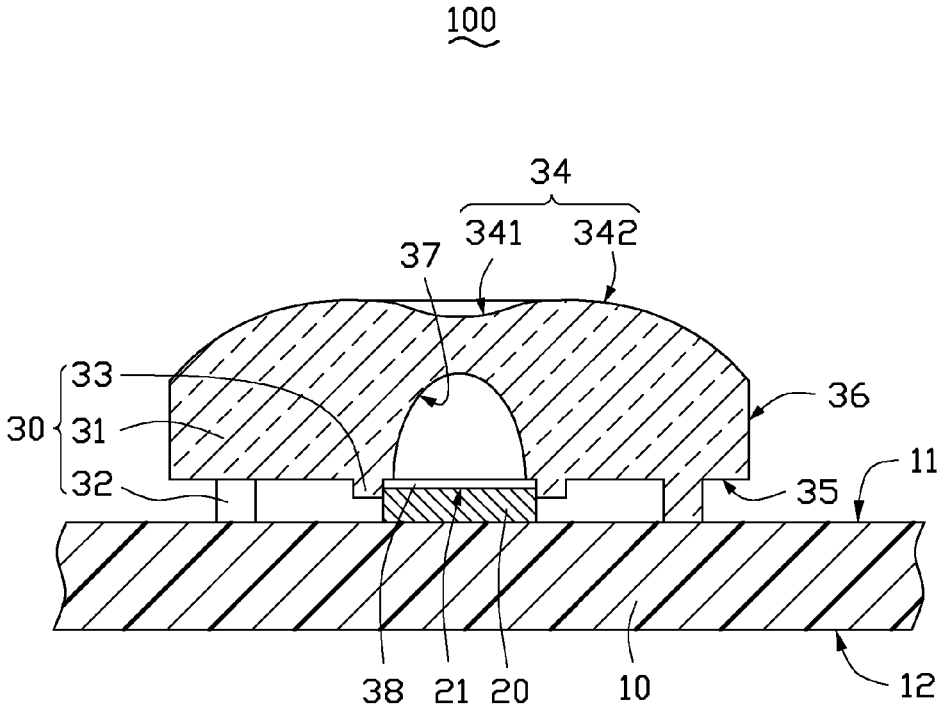
FIG. 2 is a cross-sectional view of the light source module in accordance with a first embodiment of the present disclosure, as taken along line II-II of FIG. 1.

Referring to FIGS. 1 and 2, a light source module 100 in accordance with a first embodiment is shown. The light source module 100 includes a substrate 10, an LED package 20 mounted on the substrate 10, and a lens 30 disposed on the substrate 10 and covering the LED package 20 whereby light generated by the LED package 20 can be refracted by the lens 30 to obtain a desired light distribution.

A cross section of the substrate 10 is rectangular. The substrate 10 includes a top surface 11 and a bottom surface 12 opposite to the top surface 11. The top surface 11 is flat with circuits (not shown) arranged thereon. In this embodiment, the substrate 10 is a printed circuit board.

The LED package 20 is formed on the top surface 11 of the substrate 10. The LED package 20 electrically connects with circuits of the substrate 10. The LED package 20 includes a lighting outputting surface 21. Lights generated from the LED package 20 emits outward via the light outputting surface 21. Alternatively, a chip received in the LED package 20 can be a chip assembly having a plurality of chips capable of emitting light with different wavelengths.

The lens 30 includes a light guiding portion 31, a supporting portion 32 supporting the light guiding portion 31, and a latching portion 33 extending downwardly from the light guiding portion 31.

Specifically, the light guiding portion 31 includes a top surface 34, a bottom surface 35 opposite to the top surface 34, and a side surface 36 interconnecting the top surface 34 and the bottom surface 35.

The top surface 34 includes a recessed section 341 at a center thereof and an arc section 342 at an outer periphery of the recessed section 341. The recessed section 341 is concave and depressed toward the LED package 20. The arc section 342 is convex and oriented towards a direction away from the LED package 20. A curvature radius of the arc section 342 is greater than that of the recessed section 341. The side surface 36 is vertical, and interconnects an outer periphery of the arc section 342 and an outer periphery of the bottom surface 35.

In this embodiment, the bottom surface 35 is annular. An optical concave 37 is depressed from a center of the bottom surface 35 toward the top surface 34. The optical concave 37 is aligned with the recessed section 341. The optical concave 37 is above the LED package 20 and corresponds to the LED package 20. In this embodiment, the optical concave 37 is domical. A bore diameter of the optical concave 37 gradually decreases from the bottom surface 35 to the top surface 34 along an optical axis of the lens 30.

The supporting portion 32 is located at a periphery of the bottom surface 35. In this embodiment, the supporting portion 32 is designated as three supporting posts evenly spaced from each other. Alternatively, the supporting portion 32 can be annular, or have a shape of a long strip.

The latching portion 33 extends downwardly from the bottom surface 35. The latching portion 33 is integrally formed on the bottom surface 35 of the lens 30 and located around the optical concave 37. The latching portion 33 is surrounded by the supporting portion 32. A real estate occupied by the latching portion 33 is smaller than that occupied by the bottom surface 35. In this embodiment, the latching portion 33 is a rectangular ring protruding downwardly from the bottom surface 35. The latching portion 33 includes four long strips 331 connecting each other to form the rectangular ring. A rectangular engaging hole 38 is defined and surrounded by the latching portion 33. Each length and width of the engaging hole 38 of the latching portion 33 is larger than the bore diameter of the optical concave 37. In other words, a real estate occupied by the engaging hole 38 is larger than that occupied by the optical concave 37, while centers of the engaging hole 38 and the optical concave 37 are aligned with each other and both located at the optical axis of the lens 30.

A step is formed by a portion of the bottom surface 35 between the latching portion 33 and the optical concave 37. A top end of the LED package 20 is fittingly received in the engaging hole 38 with a top surface of the LED package 20 engaging with the step.

A height of the latching portion 33 is lower than that of the supporting portion 32.

When the light source module 100 is assembled, the LED package 20 is mounted on the substrate 10 by SMT, and then the lens 30 is attached to the substrate 10. Specifically, the top end of the LED package 20 is fittingly received in the engaging hole 38, so that a relative position of the LED package 20 and the optical concave 37 of the lens 30 is accurate. In this embodiment, the light outputting surface 21 is received in the engaging hole 38 and abuts against the bottom surface 35 defining the step. Alternatively, the light outputting surface 21 can also be spaced from the bottom surface 35 with a small gap. That is, the light outputting surface 21 is lower than the bottom surface 35. The only requirement is that the upper end of the LED package 20 is fittingly received in the engaging hole 38 defined by the latching portion 33.

Since the lens 30 includes a latching portion 33 adjacent to the periphery of the optical concave 37, an engaging hole 38 is defined by the latching portion 33 for receiving the LED package 20. Therefore, a relative position between the LED package 20 and the lens 30 is accurate, whereby the top surface 34 of the lens 30 can correctly refract the light from the light outputting surface 21 of the LED package 20 to obtain the required light distribution.

Figure 3:
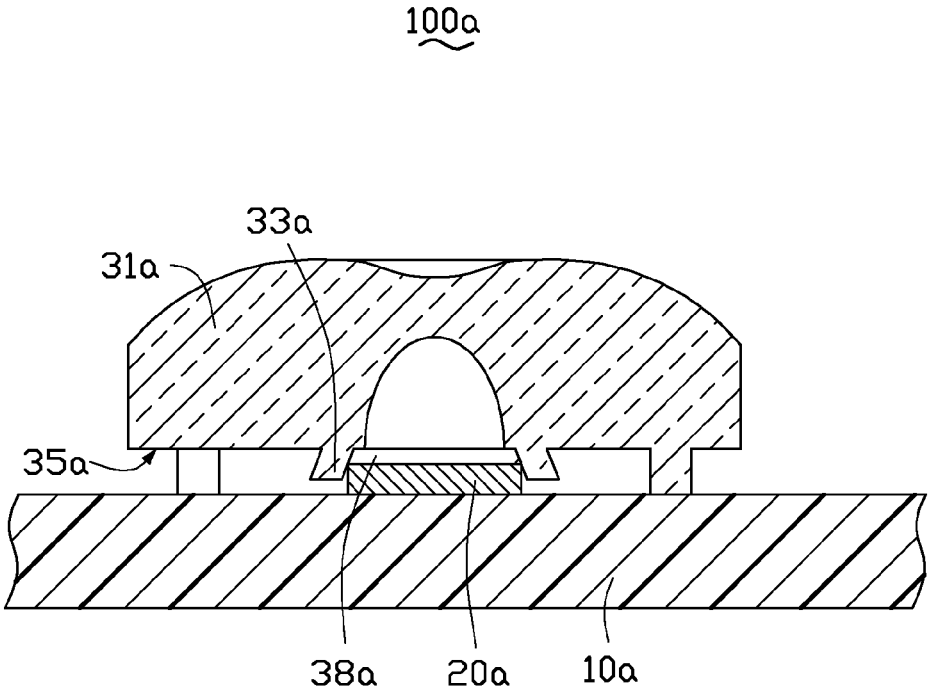
FIG. 3 is a cross-sectional view of a light source module in accordance with another embodiment of the present disclosure.

Referring to FIG. 3, a light source module 100*a* in accordance with a second exemplary embodiment is shown. The light source module 100*a* is similar to the light source module 100 of the first embodiment. The difference is that, the latching portion 33*a* of the lens 30*a* obliquely extends from the bottom surface 35*a* toward the substrate 10*a*. In this embodiment, a size of the engaging hole 38*a* defined by an inner surface of the latching portion 33*a* gradually increases from the bottom surface 35*a* to the substrate 10*a*. The LED package 20*a* is easier to slide into the engaging hole 38*a* along the inner surface of the latching portion 33*a* to be fittingly engaged with the latching portion 33*a*.

The engaging holes 38, 38*a* respectively defined by latching portions 33, 33*a* are not limited to be square. The engaging holes 38, 38*a* can also be circular, triangular and so on.

It is to be understood that the above-described embodiments are intended to illustrate rather than limit the disclosure. Variations may be made to the embodiments without departing from the spirit of the disclosure. The above-described embodiments illustrate the scope of the disclosure but do not restrict the scope of the disclosure.

What is claimed is:

1. A light source module comprising:

a substrate having a flat top surface;

an LED package mounted on the substrate and electrically connecting with the substrate, the LED package comprising a light outputting surface; and a lens disposed on the substrate, the lens comprising a light guiding portion and a latching portion extending downwardly from the light guiding portion, the light guiding portion comprising a top surface and a bottom surface opposite to the top surface, a center of the bottom surface being depressed toward the top surface to form an optical concave, a latching portion being formed at a bottom surface and located around the optical concave, the LED package being fittingly received in an engaging hole defined by the latching portion, the latching portion being annular shaped, the latching portion extends downwardly from the bottom surface and a real estate occupied by the latching portion is smaller than that occupied by the bottom surface, a step being formed by a portion of the bottom surface between the latching portion and the optical concave, the light outputting surface being spaced from the step, the light outputting surface being lower than the bottom surface.

2. The light source module of claim 1, wherein the engaging hole is below a bottom end of the optical concave, a real estate occupied by the engaging hole of the latching portion being larger than that occupied by the optical concave.

* * * * *